United States Patent [19]

Gibbs et al.

[11] Patent Number: 4,823,427

[45] Date of Patent: Apr. 25, 1989

[54] ELASTIC DUST MOP HEAD COVER

[75] Inventors: Lesley L. Gibbs, Norcross; Charles J. Morell, Dunwoody, both of Ga.

[73] Assignee: Kimberly-Clark Corporation, Neenah, Wis.

[21] Appl. No.: 848,431

[22] Filed: Apr. 4, 1986

[51] Int. Cl.[4] ..... A46B 17/04; A47L 13/44

[52] U.S. Cl. ..... 15/247; 15/104.93; 428/121; 428/122; 428/152; 428/192; 428/913

[58] Field of Search ..... 15/247, 104.93, 228, 15/231, 232, 233, 227; 428/192, 152, 121, 122, 130, 913; 382/112, 118; 150/52 R

[56] References Cited

U.S. PATENT DOCUMENTS

| | | | |
|---|---|---|---|
| 1,114,163 | 10/1914 | Mansfield | 15/172 X |
| 1,544,312 | 6/1925 | Gray . | |
| 2,030,746 | 2/1936 | Galligan . | |
| 2,125,495 | 8/1938 | French . | |
| 2,343,374 | 3/1944 | Hargreaves . | |
| 2,546,505 | 3/1951 | Heron | 15/247 |
| 2,905,581 | 9/1959 | Maxey . | |
| 2,963,731 | 12/1960 | Hoots | 15/247 |
| 3,316,136 | 4/1967 | Pufahl . | |
| 3,400,420 | 9/1968 | Granville et al. | 15/104.93 |
| 3,468,748 | 9/1969 | Bassett . | |
| 3,644,157 | 2/1972 | Draper . | |
| 3,673,026 | 6/1972 | Brown . | |
| 3,687,797 | 8/1972 | Wideman . | |
| 3,694,815 | 10/1972 | Burger . | |
| 3,828,367 | 8/1974 | Bourgeois . | |
| 3,842,832 | 10/1974 | Wideman . | |
| 3,849,241 | 11/1974 | Butin . | |
| 3,868,729 | 3/1975 | Lynam . | |
| 3,873,403 | 3/1975 | Edelman . | |
| 3,877,103 | 4/1975 | Nash . | |
| 4,081,301 | 3/1978 | Buell . | |
| 4,100,324 | 7/1978 | Anderson . | |
| 4,181,762 | 1/1980 | Benedyk . | |
| 4,209,563 | 6/1980 | Sisson . | |
| 4,225,998 | 10/1980 | Thielen . | |
| 4,259,220 | 3/1981 | Bunnelle . | |
| 4,297,157 | 10/1981 | Van Vliet . | |
| 4,305,990 | 12/1981 | Kelly . | |
| 4,375,446 | 3/1983 | Fujii . | |
| 4,397,645 | 8/1983 | Buell . | |
| 4,413,623 | 11/1983 | Pieniak . | |
| 4,434,205 | 2/1984 | Fujii . | |
| 4,450,026 | 5/1984 | Pieniak . | |
| 4,476,180 | 10/1984 | Wnuk . | |
| 4,508,113 | 4/1985 | Malaney . | |
| 4,510,640 | 4/1985 | Omori | 15/227 X |
| 4,525,407 | 6/1985 | Ness . | |
| 4,543,099 | 9/1985 | Bunnelle . | |
| 4,552,603 | 11/1985 | Harris . | |
| 4,555,811 | 12/1985 | Shimalla . | |
| 4,588,630 | 5/1986 | Shimalla . | |
| 4,606,964 | 8/1986 | Wideman | 428/152 |
| 4,720,415 | 1/1988 | Wielen et al. | 428/152 |
| 4,741,944 | 5/1988 | Jackson et al. | 428/152 |

FOREIGN PATENT DOCUMENTS

| | | | |
|---|---|---|---|
| 2260716 | 5/1974 | Fed. Rep. of Germany . | |
| 318025 | 8/1929 | United Kingdom | 15/233 |

OTHER PUBLICATIONS

Shell Chemical Company Technical Bulletin, SC:198-83, pp. 1-6 and 9-20, (date unknown).

Shell Chemical Company Technical Bulletin, SC:165-77, pp. 1-6, (date unknown).

Chicopee Brochure No. 000L-205, "Introducing the New Chicopee Dusting Tool," Copyright 1984.

Chicopee Brochure No. 000L-115, "Improved Masslinn Cleaning Cloths," Copyright 1982.

3M Brochure No. AA-FDDB-1(4115) DP1, "New 3M Doodleduster System," Copyright 1981.

*Primary Examiner*—Peter Feldman

*Attorney, Agent, or Firm*—Karl V. Sidor

[57] ABSTRACT

An abrasion-resistant elastic cloth which exhibits excellent dust pickup and dust retention is disclosed. A dust mop head cover may be formed from the cloth fabric. The dust mop head cover may be secured to the mop head without fasteners.

48 Claims, 2 Drawing Sheets

ELASTIC DUST MOP HEAD COVER

FIELD OF THE INVENTION

The present invention is concerned with the manufacture of dusting and cleaning products.

BACKGROUND OF THE INVENTION

Janitorial wipers form a significant business market. Most of the janitorial market is dominated by conventional woven rag products, including terrycloth toweling, mixed rags, huck and near white rags. A small but significant portion of the market is made up of nonwoven disposable materials, such as, for example, treated bonded carded webs (BCW).

The primary tasks performed by janitorial workers include wiping, dusting, and polishing various surfaces including furniture, floors of various materials and textures, and bathroom fixtures. The major implements include treated dust cloths, treated dust mops, and rags for all purpose wipes.

Some manufacturers produce dusters which are sized so as to be used with specially manufactured holders. In U.S. Pat. No. 4,225,988 to Thielen, assigned to 3M Company, such a holder or dust mop frame is disclosed. 3M produces a melt-blown product in a relatively narrow perforated roll form for use with the dust mop frame in Thielen. The dust mop frame has clips which are adapted to secure the cloth to the mop.

Johnson & Johnson produces a variety of dusting cloths sized so that when folded they may be used with a corresponding dust mop frame having resilient fingers for holding the cloth. The fingers are incorporated in flexible plastic valve-like structures into which a gathered portion of the cloth may be secured by a digitally implemented force fit insertion. See for example U.S. Pat. No. 3,877,103 to Nash and assigned to Johnson & Johnson.

The cloths used with these devices do not exhibit elasticity and recovery as defined herein so that it is difficult to snugly fit the cloth to the dust mop frame for best results. Further, in our opinion, these products do not adequately resist abraison, pickup sufficient amounts of dust (whether or not treated) or slide readily on various surfaces.

DESCRIPTION OF THE DRAWINGS

FIG. 6 is an illustration of the cover of FIG. 5 stretch fitted over a typical sponge mop head or the like.

SUMMARY OF THE INVENTION

Figure 1:
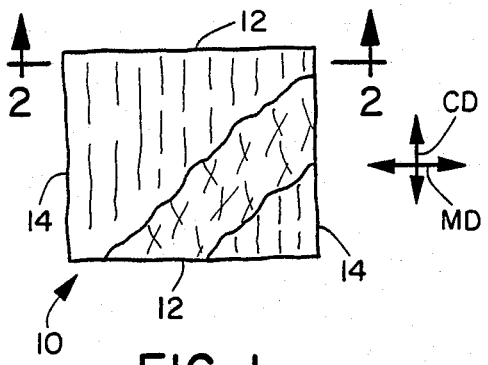
FIG. 1 is a fragmented top plan view of a section of cloth formed in accordance with the teachings of the present invention.

The invention deals with an elastic dust cloth having specific properties. More particularly, the invention deals with a shaped dust cloth formed of a nonwoven elastic gathered laminate for use as a closely conforming cover for a dusting implement, such as a dust mop frame and the like.

A dust cloth has been provided formed of a composite nonwoven web of elastic fibers having elasticity in at least one direction (preferably the machine direction); a dust gathering capacity of at least 0.185 grams per inch square of web; and abrasion resistance of at least 50 cycles on a Taber scale. The composite web is formed of a laminate of gatherable spun-bonded fibers bonded to an elastic melt-blown nonwoven web while the elastic web is in an extended or stretched condition so that when relaxed the gatherable web becomes gathered and exhibits bulk. The web exhibits an Ames bulk of at least about 0.070 inches; a non-linting characteristic of less than about ten (10) particles sized at about ten (10) microns when measured on a Climet scale; a water absorbency of at least about 150%; an oil absorbency of at least about 400%; a stretchability of at least about 25% and a recovery of at least about 80%; a grab tensile strength of at least about 5 lbs. and trap tear strength of at least about 3 lbs.; a drape of less than about 4 cm; a dynamic coefficient of friction of not more than about 1; a thermal stability to at least about 140° F. and a chemical resistance to at least one of the group of caustic, ammonia, polypropylene glycol and oil.

In one embodiment the elastic dust cloth has been formed into a cover for a dusting implement. The cover is formed from a length of the disposable nonwoven elastic dust cloth described herein having respective opposed machine direction and cross-machine direction marginal edges, the length of web being folded lengthwise with the fold line in the machine direction and with the machine direction marginal edges in closely spaced relation forming a slit. Adjacent portions of each of the cross-machine direction marginal edges are secured to each other to form closed cross-machine direction marginal edges. The cover is adapted to receive the dusting implement therein through the slit by stretching the cover over the implement in the machine direction. The cover recovers sufficiently when released to closely conform to the implement and remain secured thereover.

The elastic nonwoven web of the cloth may be formed of materials selected from the group including poly(ethylene-vinyl acetate), thermoplastic polyurethanes sold by B F Goodrich under the trademark ESTANE and elastomeric A-B-A′ block copolymer resins sold by Shell Chemical Company under the trademark KRATON, and blends of these compatible resins, generally those formed from monomers having olefinic undersaturation. The resinous microfibers may be coformed with one of more secondary fibers, such as staple natural or synthetic fibers, or wood pulp fibers. The gatherable web of the cloth may be formed of material preferably selected from the group including polyethylene, propropylene and mixtures thereof.

Although a variety of materials are useful for fabricating the cloth of the present invention as will be hereinafter set forth, in one embodiment the elastic dust cloth of the present invention is a laminate formed of a nonwoven elastic layer of melt-blown poly(ethylene-vinyl acetate) bonded to surface layers of gathered nonwoven spun-bonded polyolefins such as polyethylene and/or polypropylene. The surface layers are bonded to the nonwoven elastic ethylene-vinyl acetate layer while the ethylene-vinyl acetate layer is in a stretched condition so that upon relaxing the elastic layer, the surface layers gather improving the bulk and dust carrying capacity of the cloth. Besides giving strength and resiliency to the cloth, the elastic layer allows the cloth to be formed into a dust mop cover which may be attached to a dust mop frame without fasteners of any kind.

The fibrous elastic web may also comprise a composite material in that it may be comprised of two or more individual coherent webs laminated together or it may comprise one or more webs individually comprised of a mixture of elastic and non-elastic fibers sometimes referred to as coformed web. As an example of the latter type of elastic web, reference is made to U.S. Pat. No. 4,209,563 in which elastomeric and non-elastomeric fibers are co-mingled to form a single coherent web of randomly dispersed fibers. Another example of such a composite web would be one made by a technique such as disclosed in U.S. Pat. No. 4,100,324 issued July 11, 1978, to Richard A. Anderson et al. and assigned to the assignee of this application. That patent discloses a nonwoven material comprised of a mixture of melt-blown thermoplastic and other fibers which are combined in the gas stream in which the melt-blown fibers are borne so that an intimate entangled co-mingling of thermoplastic melt-blown fibers and other fibers, e.g., wood pulp or staple fibers, occurs prior to collection of the fibers upon a collecting device to form a coherent web of randomly dispersed fibers. The disclosure of U.S. Pat. No. 4,100,324 is also incorporated by reference herein.

In the present invention not only is the dust capacity excellent, the preferred cloth has relatively high abrasion resistance and good slidability. The cloth resists tearing quite readily because it has high tensile strength, because it slides easily, and because it is elastic. The elasticity also provides the added advantage of allowing the cloth to be formed into a cover for a mop head or other dusting implement which, because of its elasticity, holds onto and closely conforms to the implement and yet needs no other form of fastener.

These and other features of the present invention are hereinafter set forth in connection with the following definitions, specification and drawings and the appended claims.

DEFINITIONS

The terms "elastic" and "elastomeric" are used interchangeably herein and mean any material which, upon application of a biasing force, is stretchable to a stretched, biased length which is at least about 125 percent, that is about one and one-quarter, of its relaxed, unbiased length, and which will recover at least about 40 percent of its elongation upon release of the stretching, biasing force. A hypothetical example which would satisfy the definition of an elastomeric material would be a one (1) inch sample of a material which is stretchable to at least 1.25 inches and which, upon being elongated to 1.25 inches and released will recover to a length of not more than 1.15 inches. Many elastic materials may be stretched by much more than 25 percent of their relaxed length and many of these will recover to substantially their original relaxed length upon release of the stretching, biasing force and this latter class of materials is generally preferred for purposes of the present invention.

As used herein the term "recover" refers to a contraction of a stretched material upon termination of a biasing force following stretching of the material by application of the biasing force thereto. For example, if a material having a relaxed, unbiased length of one (1) inch was elongated 50 percent by stretching to a length of one and one-half (1.5) inches the material would have a stretched length that is 150 percent of its relaxed length. If this exemplary stretched material contracted, that is recovered, to a length of one and one-tenth (1.1) inches, after release of the biasing and stretching force, the material would have recovered 80 percent (0.4 inch) of its elongation.

As used herein the terms "nonelastic" or "nonelastomeric" refer to and include any material which is not encompassed by the terms "elastic" or "elastomeric".

As used herein the term "melt-blown microfibers" refers to small diameter fibers having an average diameter not greater than about 100 microns, for example having an average diameter of from about 0.5 microns to about 50 microns, more particularly having an average diameter of from about 4 microns to about 40 microns and which are made by extruding a molten thermoplastic material through a plurality of fine, usually circular, die capillaries as molten threads of filaments into a high velocity gas (e.g. air) stream which attenuates the filaments of molten thermoplastic material to reduce their diameter to the range stated above. Thereafter, the melt-blown microfibers are carried by the high velocity gas stream and are deposited on a collecting surface to form a nonwoven web of randomly dispersed melt-blown microfibers. Such a process is disclosed, for example, in U.S. Pat. No. 3,849,241 to Butin and the disclosure of this patent is hereby incorporated by reference.

As used herein the term "spun-bonded microfibers" refers to small diameter fibers having an average diameter not greater than about 100 microns, for example having a diameter of from about 10 microns to about 50 microns, more particularly having an average diameter of from about 12 microns to about 30 microns and which are made by extruding a molten thermoplastic material as filaments through a plurality of fine, usually circular, capillaries of a spinnerette with a diameter of the extruded filaments then being rapidly reduced as by, for example, eductive drawing or other well known spun-bonding mechanisms. The product of spun-bonded nonwoven webs is illustrated in U.S. Pat. No. 4,340,563 to Appel and the disclosure of this patent is hereby incorporated by reference.

As used herein the term "nonwoven web" includes any web of material which has been formed without use of textile weaving processes which produce a structure of individual fibers which are interwoven in an identifiable repeating manner. Specific examples of nonwoven webs would include, without limitation, a melt-blown nonwoven web, a spun-bonded nonwoven web, an apertured film, a microporous web or a carded web of staple fibers. These nonwoven webs have an average basis weight of not more than about 300 grams per square meter. For example, the nonwoven webs may have an average basis weight of from about 5 grams per square meter to about 100 grams per square meter. More particularly, the nonwoven webs may have an average basis weight of from about 10 grams per square meter to about 75 grams per square meter.

As used herein the term "consisting essentially of" does not exclude the presence of additional materials which do not significantly affect the elastomeric properties and characteristics of a given composition. Exemplary materials of this sort would include, pigments, anti-oxidants, stabilizers, surfactants, waxes, flow promoters, solid solvents, particulates and materials added to enhance processability of the composition.

Unless specifically set forth and defined or otherwise limited, the terms "polymer" or "polymer resin" as used herein generally include, but are not limited to, homopolymers, copolymers, such as, for example, block graft, random and alternating copolymers, terpolymers, etc. and blends and modifications thereof. Furthermore, unless otherwise specifically limited, the terms "polymer" or "polymer resin" shall include all possible geometrical configurations of the material. These configurations include, but are not limited to, isotactic, syndiotactic and random symmetries.

DETAILED DESCRIPTION

Figure 2:
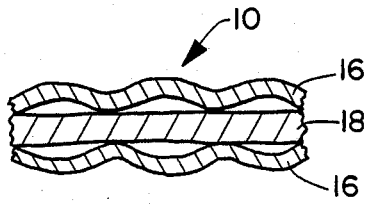
FIG. 2 is a cross sectional view of the cloth of FIG. 1 along lines 2—2 thereof.

FIG. 1 is a fragmented plan section view of an elastic dust cloth 10 of the present invention. FIG. 2 is a cross-sectional view of the cloth 10 illustrated in FIG. 1, taken along line 2—2 of FIG. 1. The dust cloth or cloth 10 has a peripheral edge including machine direction (MD) lateral margins 12, and cross-machine direction (CD), lateral margins 14. As is well known in the art, the machine direction is that direction in which a web or cloth is formed and the cross-machine direction is generally perpendicular thereto. The machine and cross-machine directions and their relative orientations are referred to for the sake of clarity and should not be construed as having a limiting effect on the subject invention.

Although it is contemplated that a single sheet of material may form the cloth 10, in one embodiment the cloth 10 is formed of a composite trilaminate of three webs bonded, nonwoven fibers. In particular, the cloth 10 is formed of one or more gatherable nonwoven fibrous surface webs 16 which have been joined to a nonwoven fibrous elastic web 18 by spot bonding at bonding locations that are spaced from each other. Following the bonding, the nonwoven elastic web 18 is relaxed from the stretched, biased length to a relaxed, unbiased, non-stretched length and the fibrous, nonwoven surface webs 16 are gathered as illustrated in FIG. 2. The fibrous nonwoven gatherable webs 16 may be formed directly onto a surface of the nonwoven elastic web 18 while the nonwoven elastic web is maintained in a stretched, biased and elongated condition. See for example Morman et al., U.S. Pat. No. 4,657,802, referred to hereinafter and incorporated herein by reference. Alternatively, the nonwoven elastic web 18 and the gatherable webs 16 may be separately formed and joined together n a process where the elastic web 18 is maintained in a tensioned or stretched condition while each gatherable web 16 is bonded thereto at discrete conditions that are spaced from each other, for example in a repeating pattern. Thereafter the composite web 10 is relaxed so that the elastic web 18 contracts and each gatherable web 16 is gathered to form a composite elastic bulked cloth 10. See for example Vander Wielen et al., U.S. Pat. No. 4,720,415, referred to hereinafter and incorporated herein by reference. If desired, additional webs or fibrous sheets may be interposed between the elastic webs 18 and the surface webs 16.

In FIGS. 1 and 2, the nonwoven elastic web 18 may be formed from melt-blown microfibers of elastomeric material selected from the group consisting of poly-(ethylene-vinyl acetate), thermoplastic polyurethanes, or an A-B-A′ block copolymers wherein A and A′ may be of the same or different endblocks and each formed independently of the other of a thermoplastic polymer which contains a styrenic moiety such as polystyrene or a polystyrene homolog and B is an elastomeric polymer midblock or segment of a a material such as poly(ethylene-butylene), polyisoprene and polybutadiene. These materials, and in particular the A-B-A′ block copolymer materials, may desirably be blended with polyolefins. The thermoplastic polyurethanes are sold by B F Goodrich under the trademark ESTANE. The A-B-A′ block copolymers are sold by the Shell Chemical Company under the trademark KRATON in several grades. These preferred materials are set forth in greater detail in the related patent applications referred to at the end of this specification and are hereby incorporated by reference.

The water or oil absorbency of the elastic layer 18 may be enhanced the by introduction therein of fibrous materials such as wood pulp fibers or staple fibers such as natural materials occurring in various lengths or synthetic fibers cut to length in a coforming process. The staple fibers, for example cotton or wool, or pulp fibers are introduced into the melt-blown stream, thereby becoming entwined with the microfibers formed therein thus forming an entangled web of elastic microfibers and staple fibers or pulp fibers which may therafter be bonded in a calendering process The surface webs 16 are preferably coherent nonwoven nonelastic webs of spun-bonded microfibers formed of materials such as polyolefins, for example, polyethylene, polypropylene, or copolymers, blends or mixtures thereof. The surface webs 16 may be formed of bonded carded web materials.

In one embodiment, the cloth 10 is stretchable in the machine direction only. However, it is possible to provide stretch in two directions at additional cost. Unidirectional stretch appears to provide sufficient flexibility for the applications hereinafter set forth. Should dual stretching capabilities be desired, it would be necessary to stretch the elastomeric web 18 simultaneously in the machine direction and cross-machine direction during the step of bonding the surface webs 16 thereto.

Figure 3:
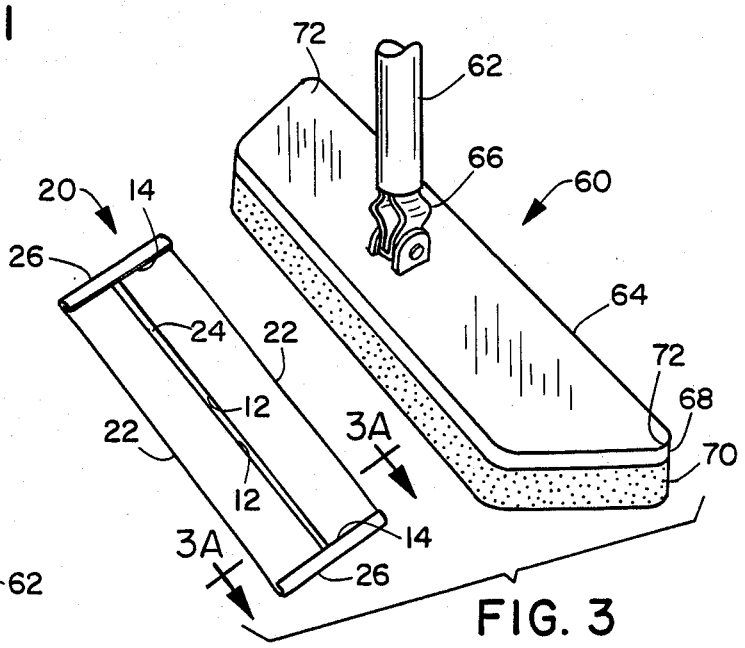
FIG. 3 is an illustration of a section of cloth formed in accordance with the teachings of the present invention and a dust mop located adjacent thereto to show the relative size of one with respect to the other.

In FIG. 3 there is shown, a dust mop head cover 20 (sometimes hereinafter cover 20), formed from a length of cloth 10. Adjacent the cover 20 is a mop 60 shown in somewhat exaggerated form for purposes of illustration to have dimensions relatively larger than the cover 20. The mop 60 may include a handle 62, a dust mop frame 64 and a universal joint 66 joining the frame 64 with the handle 62 so as to allow flexibility in turning and moving the mop 60 along floors, into corners, along walls and the like. Preferably, the frame 64 is formed of a rigid plastic upper member 68 and a foam rubber pad 70 adhered thereto as shown.

Figure 3A:
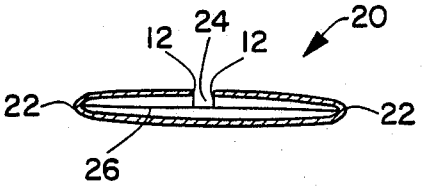
FIG. 3A is a sectional view of the dust mop cover taken along line 3A—3A of FIG. 3.

A web of cloth 10 may be used to form the dust mop head cover 20 by folding the cloth 10 along folds 22 in the machine direction so that the machine direction lateral edges 12 meet more or less centrally of the cover 20 and preferably in near abutting relationship as shown in FIG. 3A. The lateral edges 12 form a slit 24 lying between the folds 22 as shown. Of course, the marginal edges 12 may overlap or be spaced as desired, in that the near abutting arrangement shown is illustrative of one embodiment only. Cross-machine direction marginal edges 14 double back on each other in juxtaposed relationship as shown in FIG. 3 and are joined together to form closed marginal edges 26. Preferably, the material forming the cloth 10 is thermoplastic so that in the preferred embodiment the closed edges 26 may be made by a heat sealing process.

Figure 4:
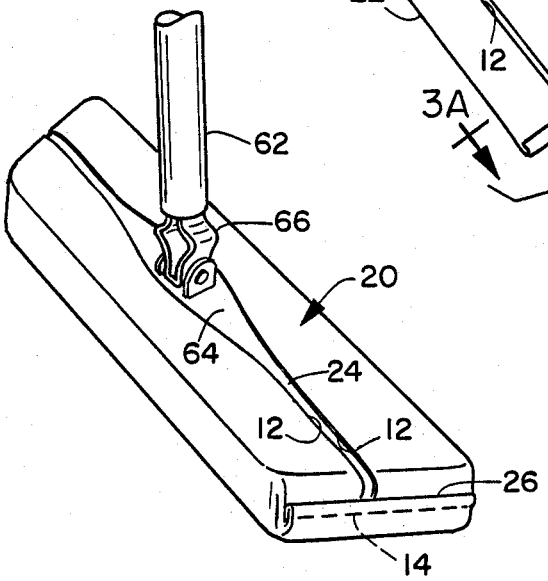
FIG. 4 is a perspective illustration of the dust mop frame covered by the cloth illustrated in FIG. 3, but in a stretched condition.

FIG. 4 illustrates an arrangement of the dust mop cover 20 in which frame 64 of mop 60 is inserted through the slit 24 and covered in closely forming relation by the cover 20. Because the cover 20 has overall dimensions smaller than the frame 64, when the frame 64 is inserted in the cover 20 through the slit 24, the user must stretch the cover 20 to fit over the frame 64 beyond, for example, ends 72 of the rigid member 68. The user then releases the cover 20 and by minor adjustment, the cover 20 is elastically secured solely by the elastic retractive forces of the cloth causing the cover 20 to closely conform to the frame 64 as shown in FIG. 4.

It should be understood that in the trilaminate arrangement illustrated in FIGS. 1 and 2, the surface layers 14 forming exterior and interior surfaces of the dust mop head cover 20 are preferably the same material. Thus, after some use, the cover 20 may be removed from the frame 64 and turned inside out exposing a clean surface for further use. Thereafter, the cover 20 may be removed, washed for reuse at a later time, or discarded.

Figure 5:
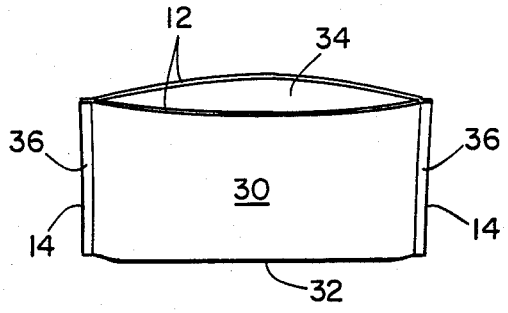
FIG. 5 is an alternative embodiment of the cloth of the present invention formed into a dust mop cover having an edgewise slit opening.
Figure 6:
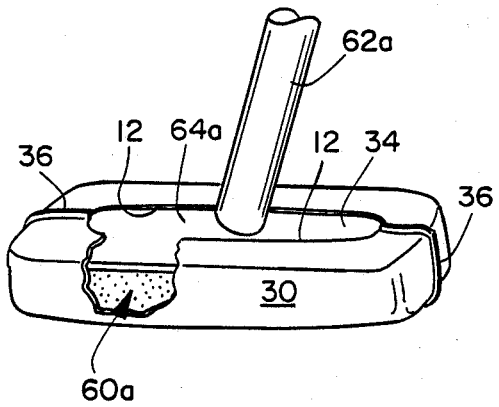

FIGS. 5 and 6 illustrate another embodiment of the invention in which the cloth 10, shown in FIG. 1, forms a dust mop head cover 30 (cover 30). The cloth 10 is folded once in the machine direction, shown at reference numeral 32, so that machine direction lateral edges 12 meet to form the slit 34 opposite the fold 32. The cross-machine direction margin edges 14 are secured together to form the closed edges 36 preferably by heat sealing and the like. It can be seen by comparison of FIGS. 3 and 5 that the location of the slit 24 in FIG. 3 is central of the cover 20 and intermediate the folds 22, whereas in FIG. 5 the slit 34 is at an extreme end of the cover 30, opposite a single fold 32.

In FIG. 6, a mop **60*a* having a mop frame 64*a* and handle 62*a* is shown. The mop frame 64*a*, for example a typical sponge mop head, is inserted through the slit 34 of the cover 30 of FIG. 5. In this arrangement it can be seen that the shape of the mop frame 64 is more block-like and the cover 30, with its side slit 34 as shown, is better adapted to be installed and remain on the mop frame 64*a*** solely by the elastic retractive force.

Figure 7:
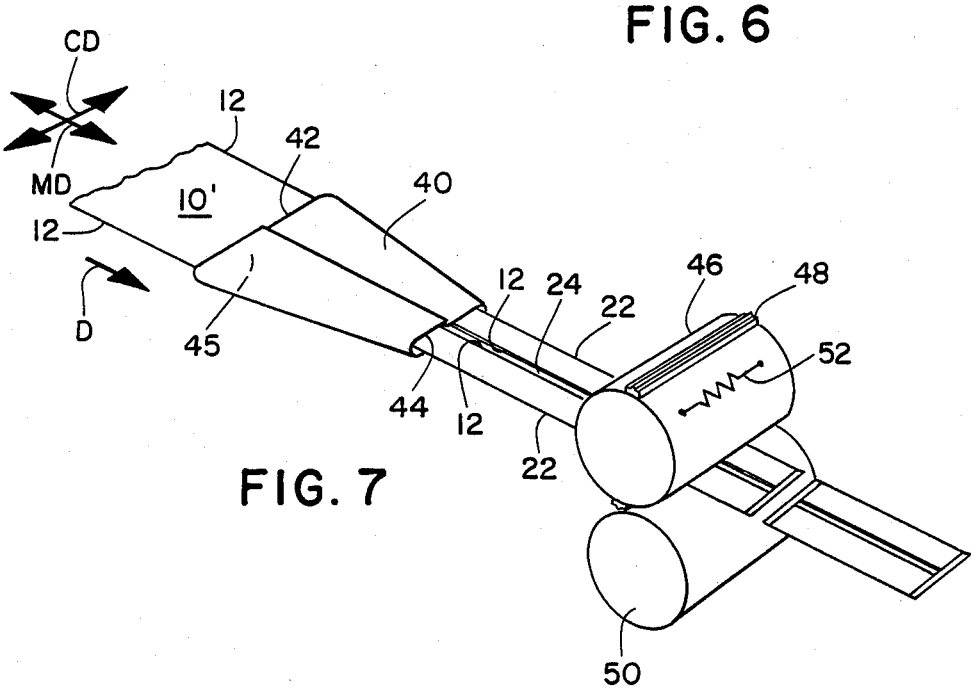
FIG. 7 is an illustration of a method of forming the cover shown in FIG. 3.

FIG. 7 shows a process for preparing the cover 20 shown in FIG. 3. In this arrangement, a continuous web of material 10', such as that forming cloth 10 shown in FIG. 1, is supplied to the relatively wide inlet end 42 of a folding board 40 of known configuration. The web 10' moves in a direction of the arrow D and exits from the relatively narrow outlet end 44 of the folding board 40. The material 10' moves along the internal surfaces 45 of the folding board 40 which resembles a flattened funnel so that machine direction marginal edges 12 move into near abutting relationship to form slit 24 while folds 22 are formed in the machine direction. Thus folded, the material 10' is passed between the nip of a heated sealing/cutting roller 46 and a backing roller 50. The heated sealing/cutting roller 46 has one or more bars 48 located thereon. The bars 48 are heated and act simultaneously to heat seal and sever the material 10' along the cross-machine direction marginal edges 16 when one of the bars 48 engages the web 10' periodically at the nip formed between the sealing/cutting roller 46 and backing roller 50 to thereby form the dust mop head cover 20 as shown. An electrical resistance heater 52 may be used to heat the sealing/cutting roller 46 or other means, such as heated oil and the like, may be used to provide sufficient heating to effectuate the heat sealing and cutting. Of course, it is to be understood that heat sealing and cutting may be separate. Also, it may be possible to heat seal and cut the edges 24 by means of an ultrasonic sealing and cutting device in place of the arrangement shown in FIG. 7.

The heating and cutting operation may be performed, for example, at about between 150° F. and 350° F. with a dwell time of up to about 3 seconds, and a nip pressure of between about 10 and 200 psi.

TEST DATA

The tables which follow show results from various materials tested for specific properties. Table I describes the materials generally either by composition or by brand name. Tables II and III set forth strength test results in the machine direction (MD) and cross-machine direction (CD) respectively. Table IV sets forth materials characteristics such as basis weight, abrasion resistance, bulk, and linting in various size particles. Table V sets forth water and oil capacity and oil pickup rate. Table VI sets forth dust pickup for some of the preferred materials and some known brands are listed for comparison. Table VII sets forth coefficient of friction data for some exemplary materials and some known brands for comparison.

TABLE I

| Sample No. | Description |
|---|---|
| 1 | 80 gsm EVA MB elastic web w/ SB PP surface webs |
| 2 | 100 gsm EVA MB elastic web w/ SB PP surface webs |
| 3 | 60 gsm EVA MB elastic web w/ SB PP surface webs |
| 4 | 80 gsm EVA MB elastic web w/ 20 gsm MB PP surface webs |
| 5 | 80 gsm EVA MB elastic web w/ BCW covers |
| 6 | 80 gsm EVA MB elastic web w/ 15 gsm MB PP surface webs |
| 7 | Chicopee BCW |
| 8 | 3M DOODLE DUSTER |
| 9 | Kleen-ups |

EVA = Ethelene Vinyl Acetate - EXXON - ESCORENE LD-764.36 Nominal Melt Index of 200 at 190° C., Vinyl Acetate Content 28% by weight
PP = Polypropylene HIMONT PC-973
BCW = Bonded Carded Web
MB = Melt-blown
SB = Spun-bonded
Basis weights noted in grams per square meter (gsm) are nominal. See Table IV for measured values.
See Daponte applications, hereinafter referred to and incorporated herein by reference for detailed characterizations of the EVA and PP materials.

TABLE II

| Sample No. | Dir. | Drape Stiffness (cm) | Grab Tensile Peak Load (lbs) | Grab Tensile Peak Elong. (%) | Trap Tear 5 Peaks (lbs) | Trap Tear 1st High (lbs) |
|---|---|---|---|---|---|---|
| 1 | MD | 2.15 | 17.10 | 125.17 | 5.68 | 7.98 |
| 2 | MD | 1.87 | 17.22 | 129.69 | 6.99 | 7.32 |
| 3 | MD | 2.08 | 14.90 | 117.78 | 5.60 | 6.01 |
| 4 | MD | 2.15 | 9.82 | 99.99 | 3.51 | 3.58 |
| 5 | MD | 2.02 | 18.51 | 103.68 | 9.05 | 9.57 |
| 6 | MD | 1.90 | 7.44 | 85.83 | 2.72 | 3.88 |
| 7 | MD | 3.65 | 13.62 | 10.08 | 2.99 | 3.07 |

TABLE II-continued

| Sample No. | Dir. | Drape Stiff-ness (cm) | Grab Tensile Peak Load (lbs) | Grab Tensile Peak Elong. (%) | Trap Tear 5 Peaks (lbs) | Trap Tear 1st High (lbs) |
|---|---|---|---|---|---|---|
| 8 | MD | 3.25 | 1.37 | 25.08 | 0.40 | 0.51 |

TABLE III

| Sample No. | Dir. | Drape Stiff-ness (cm) | Grab Tensile Peak Load (lbs.) | Grab Tensile Peak Elong. (%) | Trap Tear 5 Peaks (lbs.) | Trap Tear 1st High (lbs.) |
|---|---|---|---|---|---|---|
| 1 | CD | 3.85 | 18.37 | 59.19 | 7.65 | 7.75 |
| 2 | CD | 3.88 | 19.50 | 61.34 | 9.01 | 9.28 |
| 3 | CD | 3.58 | 16.79 | 53.65 | 8.19 | 8.19 |
| 4 | CD | 4.00 | 7.70 | 66.42 | 1.83 | 2.34 |
| 5 | CD | 3.15 | 7.59 | 142.69 | 3.24 | 3.76 |
| 6 | CD | 3.68 | 6.64 | 77.57 | 2.25 | 2.51 |
| 7 | CD | 1.50 | 2.97 | 88.03 | 0.96 | 1.10 |
| 8 | CD | 2.75 | 1.35 | 40.36 | 0.38 | 0.46 |

Drape Stiffness

This test in accordance with FTMS 191 Method 5206 is intended to determine the bending length and flexural rigidity of a fabric by employing the principle of cantilever bending of the fabric under its own weight. The value is expressed in centimeters of one-half of the overhang while the fabric is inclined at 41.5 degrees. The lower the value the more drape or less stiff and thus presumably the softer the material is to the hand. Exemplary materials had a drape stiffness as low as 1.87 cm in the machine direction. Drape preferably should not exceed 4 cm to provide a good subjective hand.

Tensile Strength

Grab tensile strength and elongation measured in accordance with FTMS 191A Method 5100 is a measure of breaking strength and stretch of a fabric when subjected to unidirectional stress. Values for grab tensile and grab stretch are attained using a specified width of fabric, clamp width and constant rate of extention. The sample is wider than the clamp to give results representative of effective strength of fibers in the clamped width combined with additional strength contributed by adjacent fibers in the fabric. This closely simulates fabric stress conditions in actual use. Results are expressed as pounds to break and percent of stretch to break. Total energy can also be expressed as well as energy to break. High numbers indicate strong or stretchable fabric. Minimum acceptable grab tensile peak load is 5 lbs in either MD or CD.

Trap tear as measured in accordance with FTMS 191A Method 5136 is a measure of the force required to propagate a tear across a fabric under constant rate of extention. A specified width of fabric cut on one edge is clamped along the non-parallel sides of a trapezoidal shape drawn on the sample. The same rates of pull as the grab method above are followed. A minimum trap tear peak strength is 3 lbs in either MD or CD.

TABLE IV

| Sample No. | Basis Weight (GSM) | Taber Abrasion (cycles) | Ames Bulk (in) | Climet Lint (10) | Climet Lint (.5) |
|---|---|---|---|---|---|
| 1 | 148.04 | 116.00 | 0.072 | 0.67 | 3.67 |
| 2 | 145.87 | 192.00 | 0.076 | 0.33 | 26.67 |

TABLE IV-continued

| Sample No. | Basis Weight (GSM) | Taber Abrasion (cycles) | Ames Bulk (in) | Climet Lint (10) | Climet Lint (.5) |
|---|---|---|---|---|---|
| 3 | 120.57 | 132.00 | 0.070 | 1.33 | 19.00 |
| 4 | 158.49 | 22.70 | 0.078 | 3.33 | 320.00 |
| 5 | 126.67 | 100.00 | 0.080 | 1.33 | 47.67 |
| 6 | 137.05 | 29.70 | 0.062 | 1.67 | 204.67 |
| 7 | 48.67 | 44.33 | 0.010 | 0.00 | 2288.00 |
| 8 | 63.72 | 3.00 | 0.052 | 2.00 | 34932.00 |

Ames Bulk

Bulk is a measure of thickness or fullness. Subjectively high bulk provides a good hand or cloth-like feel. Bulk also appears to give better dust pickup capacity. Ames bulk is a measure of fabric thickness in centimeters. A minimum Ames bulk of 0.070 in is preferred.

Abrasion Resistance

It is important that the dust cloth of the present invention exhibit good abrasion resistance. Accordingly, an abrasion resistance test, known as the Taber method outlined in FTMS-191 Method 5306 was used to evaluate certain preferred materials. The Taber abrasion relates to the resistance of a fabric to abrasion when subjected to a repetitive rotary rubbing action under controlled pressure and abrasion action. The sliding rotation of one or two abrading wheels rub together against a circular moving mounted sample to form an abraded surface pattern. Values are expressed as the number of cycles to reach a specified level of surface destruction. This specified level is visually evaluated to be comparable to a standard photograph of surface destruction. A higher number indicates a greater resistance to abrasion. Abrasion results are general indications of fabric wear performance or durability. Because of the inherently subjective nature of the test, results are reliable to use in determining relative end use performance only when large differences results appear among fabrics or a correlation between lab test results and actual end use performances have been evaluated.

The abrasion resistance of materials was evaluated using the Taber method as outlined above. A CS10 wheel and no weight or counterweight was used. The materials were abraded until they came to a photo end point relative to spun-bound materials. Preferred materials tested had exhibited a Taber abrasion of between 116 and 192 cycle. A minimum acceptable abrasion resistance of 50 cycles Taber is desired, although 100 cycles or more is preferred.

Lint Testing

Lint test procedures using a Model CI-250 particle counter manufactured by Climet Instrument Company, Redlands, Calif., sizes and counts particles shed by a fabric when bent, twisted or crushed by a laboratory fabricated particle generator. The airborne products are drawn to the Climet sensing unit which sizes and counts the light pulses scattered by the particles. Results are recorded as the number of particles in 0.01 feet cubed of air per 37 seconds that are larger than: (1) 0.5 microns and (2) 10 microns. Values are an indication of a fabric's linting propensity. Larger numbers suggest a more linty material. A preferred maximum level of 10 micron lint should not exceed about 10 particles on the Climet scale.

TABLE V

| Sample No. | Water* Capacity (%) | Oil Capacity (%) | Oil Rate (Sec) |
|---|---|---|---|
| 1 | 176 | 394 | 1.70 |
| 2 | 155 | 402 | 1.50 |
| 3 | 151 | 455 | 1.58 |
| 4 | 155 | 506 | 2.70 |
| 5 | 277 | 410 | 1.52 |
| 6 | 159 | 474 | 2.67 |
| 7 | 688 | 355 | 5.67 |
| 8 | 296 | 1338 | 3.13 |

*Water rate exceeded 60 seconds, except sample 7, which had a water rate of 2.45 seconds.

Absorbency

Capacity and rate data for both water and oil give an indication of the absorbency of the materials. The capacity is the amount of liquid absorbed relative to the weight of the material. The rate is the amount of time required for the material to absorb a given amount of liquid. The maximum amount of time allowed is sixty seconds. Preferred minimums for oil and water capacity are 400% and 150%, respectively.

TABLE VI

| Sample No. | Material | Grams of Dust |
|---|---|---|
| 1 | SBL 80 gsm MB EVA with 0.4 osy SB PP covers | 3.81 |
| 2 | SBL 100 gsm MB EVA with 0.4 osy SB PP covers | 4.94 |
| 3 | SBL 60 gsm MB EVA with 0.4 osy SB PP covers | 4.05 |
| 7 | Chickopee Stretch n' Dust | |
| | (unstretched) | 2.44 |
| | (stretched) | 3.17 |
| 8 | 3M Doodle Duster | 2.62 |
| 9 | Kleen-ups Duster | |
| | (untreated) | 1.0 |
| | (treated) | 2.0 |

osy = oz/yd$^2$

Dust Pickup

The elastic dust cloths of the present invention and articles made therefrom have certain properties which make them especially adapted for efficient and extended periods of use for disposable items. For example, the cloth 10 has very good dust pickup and retention properties. In accordance with a procedure for measuring dust pickup and retention, a 4×4 inch sample of the cloth 10 is weighed prior to the test. A cylindrical canister with baffles having a height of 6.5 inches and a diameter of 6.75 inches is placed on its side and 15 grams of a synthetic dust glass, such as glass beads of approximately 325 mesh supplied by Potter Industries, Inc. of Hasbrouck Heights, N.J., is poured evenly in a line along the side of the canister. The cansister is covered and placed in a ball mill which is allowed to tumble for 15 seconds. The sample is removed from the canister and weighed again. The difference in weight is recorded as the dust pickup in grams. Preferred materials tested in accordance with the foregoing method exhibit a dust pickup and retention of at least 3 grams per 4×4 inch sample or 0.185 grams per cubic inch. Other samples tested exhibited up to 4.94 grams of dust per 4×4 inch sample or about 0.308 grams per square inch.

Temperature and Chemical Stability

Material chosen for the dust cloths is useful when wet for relatively light duty cleaning. Accordingly, it is preferred that the web constituents be capable of resisting heat degradation of at least 140° F. That is, the material should retain its elasticity and recoverability at this temperature.

As if often the case, dust cloths are used in combination with cleaning agents of various kinds and chemical makeup. Accordingly, exemplary samples herein described have been found to be chemically stable and resistant to degradation when used with ammonia, caustic, and petroleum-based dusting spray, such as polypropylene glycol. KRATON block polymers have been found to degrade upon exposure to petroleum-based dusting sprays and other oils.

Coefficient of Friction

The coefficient of friction of some of the nonwoven samples was measured in accordance with INDA standard test IST-14.0-82 using "Coefficient of Friction Plastic Film" ASTM D1894-78 with a 200 gram sled and a constant rate of speed tensile tester. The method is used to determine the coefficient of friction of a nonwoven textile when sliding over a polished metal surface. The average results of six runs on various samples is given in Table VII below under static dynamic (kinetic) conditions.

TABLE VII

| Sample No. | Direction | INDA Coef. of Static Friction | INDA Coef. of Dynamic (Kinetic) Friction |
|---|---|---|---|
| 2 | MD | 0.61 | 0.52 |
| 3 | MD | 0.56 | 0.48 |
| 7 | MD | 0.75 | 0.63 |
| 8 | MD | 1.98 | 1.73 |

As the coefficient of friction decreases, the glidability of a fabric is enhanced. That is, it slides with less effort. A preferred maximum acceptable dynamic coefficient of friction is about one (1) according to the above INDA method.

There has therefore been provided an elastic dust cloth having high strength, high abrasion resistance, and high dust carrying capacity. These features, along with the excellent drapability and low linting, provide an excellent dust cloth for janitorial and consumer uses. In addition, the elasticity allows the cloth to be formed into a dust mop cover which snugly conforms to the dust mop or other dusting implement.

RELATED APPLICATIONS

This application is one of a group of commonly assigned patent applications which are being filed on the same date. The group includes application Ser. No. 06/843,427 continued as 07/025,557 in the name of Diego H. Daponte and entitled "Compositions Based on Ethylene-Vinyl Acetate Copolymers and Methods for Their Formation Into Elastomeric Fibrous Products"; application Ser. No. 06/843,428 continued as 07/025,770 in the name of Diego H. Daponte and entitled "Improved Composite Elastomeric Materials and Process for Making the Same", both of which are filed on even date herewith. Other related applications include U.S. Pat. No. 4,663,220, filed July 30, 1985, in the name of Tony J. Wisneski and Michael T. Morman and entitled "Polyolefin-Containing Extrudable Compositions and Methods for Their Formation Into Elastomeric Products"; U.S. Pat. No. 4,720,415, filed July 30, 1985, in the name of Jack P. Taylor and Michael J. Vander Wielen and entitled "Composite Elastomeric Material and Process for Making the Same"; and U.S. Pat. No. 4,657,802, filed July 30, 1985, in the name of Michael T. Morman and entitled "Composite Nonwoven Web". The subject matter of all of these applications is hereby incorporated herein by reference.

It is to be understood that variations and modifications of the present invention may be made without departing from the scope of the invention. It is also to be understood that the scope of the present invention is not to be interpreted as limited by the specific embodiment disclosed herein but only in accordance with the appended claims when read in the light of the foregoing disclosure.

What is claimed is:

1. A shaped elastic cover adapted to be stretchably fitted over a dusting implement in closely conforming relationship comprising: a length of elastic nonwoven maerial having a peripheral marginal edge and being elastic in at least one direction, said length of material having adjacent portions of said peripheral edge aligned in juxtaposition and joined together, the joined sections being on opposing sections of said length of elastic nonwoven material forming a pouch, and unjoined portions of said peripheral marginal edge forming a slit adapted to receive the implement therethrough into the pouch, said cover being adapted to be secured onto the dusting implement solely by elastic forces exerted by the material against the dusting implement.

2. The elastic cover of claim 1 which has a dust gathering capacity of at least about 0.185 grams per square inch of web; and an abrasion resistance of at least about 50 cycles on a Taber scale.

3. The elastic cover of claim 1 which exhibits an Ames bulk of at least about 0.07 in.

4. The elastic cover of claim 1 which exhibits a nonlinting characteristic of less than about 10 particles sized at about 10 microns on a Climet scale.

5. The elastic cover of claim 1 having a water absorbency of at least about 150% of the weight of the cloth.

6. The elastic cover of claim 1 having an oil absorbency of at least about 400% of the weight of the cloth.

7. The elastic cover of claim 1 which is stretchable by at least about 25% and recoverable by at least about 80%.

8. The elastic cover of claim 1 which exhibits a grab tensile peak load strength of at least about 5 lbs.

9. The elastic cover of claim 1 which exhibits a tear trap tensile peak load strength of at least about 3 lbs.

10. The elastic cover of claim 1 which exhibits a drape of not more than about 4 cm.

11. The elastic cover of claim 1 which exhibits a dynamic coefficient of friction of less than about 1 (INDA).

12. The elastic cover of claim 1 which exhibits a thermal stability of at least about 140° F.

13. The elastic cover of claim 1 which exhibits a chemical stability to at least one of the group of ammonia, caustic, polyethylene glycol and oil.

14. The elastic cover of claim 1 wherein said nonwoven elastic material is selected from the group consisting of one or more of poly(ethylene-vinyl acetate), thermoplastic polyurethanes, A-B-A′ block copolymers, blends of one or more of poly(ethylene-vinyl acetate), thermoplastic polyurethanes, and A-B-A′ block copolymers, and blends of one or more of poly(ethylene-vinyl acetate), thermoplastic polyurethanes, and A-B-A′ block copolymers with one or more polyolefins.

15. The elastic cover of claim 8 wherein the gathered web of spun-bonded material is selected from the group consisting of one or more polyolefins.

16. The elastic cover of claim 15 wherein the gathered surface web is formed from a material selected from the group consisting of one or more polyethylenes and one or more polypropylenes.

17. The elastic cover of claim 14 wherein at least one of said webs comprises one or more materials selected from the group consisting of staple, natural, and synthetic fibers and wood pulp fibers.

18. The elastic cover of claim 17 wherein said staple fibers are selected from the group consisting of cotton fibers, wool fibers, and cut synthetic fibers.

19. The elastic cover of claim 1 wherein said cloth includes two gathered nonwoven surface webs and an elastic nonwoven web therebetween, the peripheral edge of the cloth having respective opposed machine direction marginal edges and opposed cross-machine direction marginal edges, said cloth being folded along a line extending in the machine direction so that opposed machine direction marginal edges are in closely spaced relationship defining the slit, and the cross-machine marginal edges being the portions of the peripheral edges in overplaced juxtaposition relationship and joined together to form the pouch.

20. A disposable elastic cover for receiving an implement therein comprising a web of elastic nonwoven fibers having lateral marginal edges and transverse edges, said web being extensible in at least one direction and being folded at least once along a line extending in such direction to form at least two layers, the marginal edges in said one direction being aligned to form a slit and corresponding opposed portions of the other margins being joined together to form a cover closed along the fold and the joined together margins and open along the slit for receiving the implement therein said cover being stretchable in said one direction for facilitating the reception of the dusting implement therein and said cloth recovering when released for allowing the cover to conform closely to the implement.

21. The disposable cover of claim 20 wherein the slit is opposite the fold.

22. The disposable elastic cover of claim 20 in which the web is folded at least twice and the slit lies in one side of the cover between the folds.

23. A disposable elastomeric cover for receiving a mop frame therein comprising a web of nonwoven heat sealable thermoplastic elastic material having first and second opposed marginal edges, said web being folded so that the first marginal edges lie in opposition centrally of the web and form a slit therein, each second marginal edge being heat bonded to itself so as to form closed marginal edges of the cover for receiving the dust mop frame therein through the slit, said cover having overall dimensions smaller than corresponding overall dimensions of the mop frame so that it is necessary to stretch the cover to snugly fit the dust mop frame.

24. The cover of claim 23 wherein the web is formed of at least one layer of elastomeric nonwoven bonded fibers.

25. The cover of claim 23 wherein the web is formed of a composite elastic material having at least one gatherable web which is extensible and contractable with the elastic web upon stretching and relaxing of the composite material.

26. An elastic cover formed from a nonwoven cloth having elasticity in at least one direction, said cloth including two gatherable nonwoven surface webs and one elastic nonwoven web between the surface webs, said cloth having respective opposed machine direction and cross-machine direction lateral edges; wherein said cloth is folded along a line extending in a machine direction so that the opposed machine direction lateral edges are in substantial abutting relationship and define a slit therebetween and the cross-machine direction lateral edges are overplaced in juxtaposed relationship; and wherein the juxtaposed cross-machine direction lateral edges are joined together, whereby said slit is adapted to elastically receive an implement having at least one dimension greater than a corresponding dimension of said cover so that the cover closely conforms to and is elastically secured to said implement.

27. An elastic cover adapted to be stretchably fitted over a dusting implement in closely conforming relationship comprising: a length of cloth defined by peripheral marginal edges having elasticity in at least one direction and being folded on itself along a line extending in the direction of elasticity, portions of said peripheral marginal edges near the fold being joined in juxtaposed relationship, and portions of the peripheral margins intermediate the joined portions being in spaced relationship and forming an open slit, a pocket defined by the folded cloth and joined portions of the peripheral marginal edges for receiving the implement therein, and when the implement is relatively larger than the cover, the cover is adapted to be stretch fitted over the implement and secured thereto in closely conforming relationship by forces resulting from stretching the cover over the implement.

28. The elastic cover of claim 14, further including at least one gatherable web joined to said elastic web at least at two locations, said gatherable web being gathered between said two locations.

29. An elastic dust mop head cover comprising:

a web of thermoplastic nonwoven materials which is elastic in at least one direction and which is configured to form a pouch and to define an opening into the interior of said pouch;

wherein said opening is adapted to allow insertion of a mophead into said interior of said pouch; and wherein said cover is adapted to be secured in closely conforming relationship to said head solely by elastic forces exerted by the cover against the head.

30. The elastic cover of claim 29, wherein said thermoplastic nonwoven elastic material is selected from the group consisting of one or more of poly(ethylene-vinyl acetate), thermoplastic polyurethanes, A-B-A′ block copolymers, blends of one or more of poly(ethylene-vinyl acetate), thermoplastic polyurethanes, and A-B-A′ block copolymers, and blends of one or more of poly(ethylene-vinyl acetate), thermoplastic polyurethanes, and A-B-A′ block copolymers with one or more polyolefins.

31. The elastic cover of claim 29, further including at least one gatherable web joined to said elastic web at least at two locations, said gatherable web being gathered between said two locations.

32. The elastic cover of claim 31, wherein the gatherable web is formed from one or more polyolefins.

33. The elastic cover of claim 32, wherein the polyolefin is selected from the group consisting of one or more polyethylenes, one or more polypropylenes and blends thereof.

34. The elastic cover of claim 31, which has a dust gathering capacity of at least about 0.185 grams per inch square of web; and an abrasion resistance of at least about 50 cycles on a Taber scale.

35. The elastic cover of claim 31, which exhibits an Ames bulk of at least about 0.07 in.

36. The elastic cover of claim 31, which exhibits a non-linting characteristic of less than about 10 particles sized at about 10 microns on a Climet scale.

37. The elastic cover of claim 31, having a water absorbance of at least about 150% of the weight of the cloth.

38. The elastic cover of claim 31, having an oil absorbency of at least about 400% of the weight of the cloth.

39. The elastic cover of claim 31, which exhibits a grab tensile peak load strength of at least about 5 lbs.

40. The elastic cover of claim 31, which exhibits a tear trap tensile peak load strength of at least about 3 lbs.

41. The elastic cover of claim 31, which exhibits a drape of not more than about 4 cm.

42. The elastic cover of claim 31, which exhibits a dynamic coefficient of friction of less than about 1 (INDA).

43. The elastic cover of claim 31, which exhibits a thermal stability of at least 140° F.

44. The elastic cover of claim 31, which exhibits a chemical stability to at least one of the group of ammonia, caustic, polyethylene glycol and oil.

45. The elastic cover of claim 31, comprising two gatherable webs with each gatherable web being joined to opposite sides of said elastic web at least at two locations and being gathered between said two locations.

46. The elastic cover of claim 45, wherein at least one of said gatherable webs comprises one or more materials selected from the group consisting of staple, natural, and synthetic fibers and wood pulp fibers.

47. The elastic cover of claim 46, wherein said stable fibers are selected from the group consisting of cotton fibers, wool fibers, and cut synthetic fibers.

48. The elastic cover of claim 29, wherein said thermoplastic elastic nonwoven material includes two gathered nonwoven surface webs and an elastic nonwoven web therebetween, the peripheral edge of the cloth having respective opposed machine direction marginal edges and opposed cross-machine direction marginal edges, said cloth being folded along a line extending in the machine direction so that opposed machine direction marginal edges are in closely spaced relationship defining the slit, and the cross-machine direction marginal edges being the portions of the peripheral edges in overplaced juxtaposition relationship and joined together to form the pouch.

* * * * *

UNITED STATES PATENT AND TRADEMARK OFFICE
CERTIFICATE OF CORRECTION

PATENT NO. : 4,823,427
DATED : April 25, 1989
INVENTOR(S) : Lesley L. Gibbs and Charles J. Morell

It is certified that error appears in the above—identified patent and that said Letters Patent is hereby corrected as shown below:

In Column 6, line 34, please add a period at the end of the sentence after the word "process" -- process.--.

In Column 13, line 23, please delete "maerial" and insert -- material --.

In Column 14, line 6, please delete "claim 8" and insert -- claim 28 --.

In Column 15, line 46, please delete "materials" and insert -- material --.

In Column 16, line 48, please delete "stable" and insert -- staple --.

Signed and Sealed this

Sixteenth Day of January, 1990

*Attest:*

JEFFREY M. SAMUELS

*Attesting Officer* *Acting Commissioner of Patents and Trademarks*